United States Patent [19]

Morin

[11] Patent Number: 4,909,910

[45] Date of Patent: Mar. 20, 1990

[54] YARNS AND TOWS COMPRISING HIGH STRENGTH METAL COATED FIBERS, PROCESS FOR THEIR PRODUCTION, AND ARTICLES MADE THEREFROM

[75] Inventor: Louis G. Morin, Tarrytown, N.Y.

[73] Assignee: American Cyanamid, Me.

[21] Appl. No.: 216,707

[22] Filed: Jul. 7, 1988

Related U.S. Application Data

[60] Continuation of Ser. No. 932,925, Nov. 19, 1986, abandoned, which is a division of Ser. No. 650,583, Sep. 12, 1984, Pat. No. 4,661,403, Division of Ser. No. 584,483, Feb. 28, 1984, Pat. No. 4,069,449, which is a continuation of Ser. No. 541,611, Oct. 13, 1983, abandoned, which is a continuation of Ser. No. 358,637, Mar. 16, 1982, abandoned.

[51] Int. Cl.[4] ..... C25D 7/06

[52] U.S. Cl. ..... 204/28; 204/30; 204/35.1; 428/263; 428/367; 428/378

[58] Field of Search ..... 204/28, 30, 35.1, 20, 204/21, 22; 428/263, 367, 364, 378

[56] References Cited

U.S. PATENT DOCUMENTS

| | | | |
|---|---|---|---|
| 3,107,152 | 10/1963 | Ford et al. | 428/447.8 |
| 3,473,900 | 10/1969 | Sara | 428/367 |
| 3,495,940 | 2/1970 | Stuetz | 23/209.3 |
| 3,535,093 | 10/1970 | Sara | 428/367 |
| 3,550,247 | 12/1970 | Evans et al. | 29/419 |
| 3,571,901 | 3/1971 | Sara | 428/614 |
| 3,622,283 | 11/1971 | Sara | 428/367 |
| 3,671,285 | 6/1972 | Prescott | 428/369 |
| 3,807,996 | 4/1974 | Sara | 75/204 |
| 3,896,010 | 7/1975 | Vetter | 204/28 |
| 3,953,647 | 4/1976 | Brennan et al. | 428/378 |
| 4,050,997 | 9/1977 | Heissler et al. | 204/28 |
| 4,096,823 | 6/1978 | Schladitz | 118/48 |
| 4,132,828 | 6/1979 | Nakamura et al. | 428/389 |
| 4,169,911 | 10/1979 | Yoshida et al. | 428/389 |
| 4,201,825 | 5/1980 | Ebneth | 428/263 |
| 4,341,823 | 7/1982 | Sexton et al. | 428/614 |
| 4,357,985 | 11/1982 | Sexton | 164/61 |
| 4,367,127 | 1/1983 | Messing et al. | 204/105 R |

FOREIGN PATENT DOCUMENTS

| | | |
|---|---|---|
| 3108380 | 2/1982 | Fed. Rep. of Germany . |
| 1535660 | 8/1968 | France . |
| 5243770 | 3/1974 | Japan . |
| 59-106571 | 6/1984 | Japan . |
| 496331 | 4/1976 | U.S.S.R. . |
| 1208959 | 10/1970 | United Kingdom . |
| 1215002 | 12/1970 | United Kingdom . |
| 1272777 | 5/1972 | United Kingdom . |
| 1309252 | 3/1973 | United Kingdom . |

OTHER PUBLICATIONS

Paper No. 14, Plastics Institute, Feb. 2–4 (1971) London B. W. Howlett et al.

Izv. Akad. Nauk. Mold. SSR. Ser. Fig.-Tech. Mat. Nauk. 1975. (2) 76–80 Ponomar, et al. (Translation into English).

Voluknist i Dispersnorprochnen. Kompozitsion. Materialy 1976, 38–40 A. N. Yagubets (Translation into English).

Chem Abstracts 97:217 444K Ebneth (Bayer).

Chem Abstracts 91,201243q Murakami (Nippon Carbon).

*Primary Examiner*—John F. Niebling
*Assistant Examiner*—William T. Leader
*Attorney, Agent, or Firm*—Steven Flynn

[57] ABSTRACT

Yarns or tows of high strength composite fibers the majority of which comprise a core of carbon or the like and a thin, uniform firmly adherent electrically conductive layer or an electrodepositable metal, such as nickel or the like, the bond strength of the metal to the core being greater than 10 percent of the intermetallic bond strength of the metal layer. The composites can be produced by electrodeposition from a bath onto the core but the procedure must use external voltages high enough both (i) to dissociate the metal at the core and (ii) to nucleate the metal through the boundary layer into direct contact with the core.

15 Claims, 2 Drawing Sheets

YARNS AND TOWS COMPRISING HIGH STRENGTH METAL COATED FIBERS, PROCESS FOR THEIR PRODUCTION, AND ARTICLES MADE THEREFROM

This application is a continuation of Ser. No. 932,925 filed on Nov. 19, 1986 which a divisional of application Ser. No. 650,583 filed on Sept. 12, 1984, now allowed, which is a divisional application of Ser. No. 584,483 filed on Feb. 28, 1984, now allowed, which is a continuation application of Ser. No. 541,611 filed Oct. 13, 1983, now abandoned, which is a continuation of application of Ser. No. 358,637, filed Mar. 16, 1982, now abandoned.

BACKGROUND OF THE INVENTION

Bundles of high strength fibers of non-metals and semi-metals, such as carbon, boron, silicon carbide, and the like, in the form of filaments, mats, cloths and chopped strands are known to be useful in reinforcing metals and organic polymeric materials. Articles comprising metals or plastics reinforced with such fibers find wide-spread use in replacing heavier components made of lower strength conventional materials such as aluminum, steel, titanium, automobiles, office equipment, sporting goods, and in many other fields.

A common problem in the use of such fibers, and also glass, asbestos, and others, is a seeming lack of ability to translate the properties of the high strength fibers to the material to which ultimate and intimate contact is to be made.

The problem is manifested in a variety of ways: for example, if a length of high strength carbon fiber yarn is enclosed lengthwise in the center of a rod formed from solidified molten lead, and the rod is pulled until broken, the breaking strength will be less than expected from the rule of mixtures, and greater than that of a rod formed from lead alone, due to the mechanical entrapment of the fibers. The lack of reinforcement is entirely due to poor translation of strength between the carbon fibers and the lead. The same thing happens if an incompatible high strength fiber is mixed with a plastic material. If some types of carbon fibers, boron fibers, silicon carbide fibers, and the like in the forms of strands, chopped strands, non-woven mats, felts, papers, etc. or woven fabrics are mixed with organic polymeric substances, such as phenolics, styrenics, epoxy resins, polycarbonates, and the like, or mixed into molten metals, such as lead, aluminum, titanium, etc., they merely fill them without providing any reinforcement, and in many cases even cause physical properties to deteriorate.

All of these problems are generally recognized now, after years of research, to result fromm the need to insure adequate bonding between the high strength fiber and the so-called matrix material, the metal or plastic sought to be reinforced. It is also known that bonding can be improved with careful attention to the surface layer on each macro-micro filament or fibril in the material selected for use. Glass filaments, for example, are flame cleaned and then sized with a plastic-compatible organosilane to produce reinforcements uniquely suitable for plastics.

Such techniques do not work well with other fibrous materials and, for obvious reasons, are not suitable for carbon fibers, which would not surface texture, and which have different boundary layers.

High strength carbon fibers are made by heating polymeric fiber, e.g., acrylonitrile polymers or copolymers, in two stages, one to remove volatiles and carbonize and another to convert amorphous carbon into crystalline carbon. During such procedure, it is known that the carbon changes from amorphous to single crystal then orients into fibrils. If the fibers are stretched during the graphitization, then high strength fibers are formed. This is critical to the formation of the boundary layer, because as the crystals grow, there are formed high surface energies, as exemplified by incomplete bonds, edge-to-edge stresses, differences in morphology, and the like. It is also known that the new carbon fibrils in this form can scavenge neascent oxygen from the air, and even organic materials, to produce non-carbon surface layers which are firmly and chemically bonded thereto, although some can be removed by solvent treating, and there are some gaps or open spaces in the boundary layers. Not unlike the contaminants on uncleaned, unsized glass filaments, there boundary layers on carbon fibers are mainly responsible for failure to achieve reinforcement with plastics and metals.

Numerous unsuccessful attempts have been reported to provide such filaments, especially carbon filaments, in a form uniquely suitable for reinforcing metals and plastics. Most have involved depositing layers of metals, especially nickel and copper as thin surface layers on the filaments. Such a composite fiber was then to be used in a plastic or metal matrix. The metals in the prior art procedures have been vacuum deposited, electrolessly deposited, and electrolytically deposited, but the resulting composites were not suitable.

Vacuum deposition, e.g., of nickel, U.S. Pat. No. 4,132,828, made what appears to be a continuous coating, but really isn't because the vacuum deposited metal first touches the fibrils through spaces in the boundary layer, then grows outwardly like a mushroom, then joins away from the surface, as observed under a scanning electron microscope as nodular nucleation. If the fiber is twisted, such a coating will fall off. The low density non-crystalline deposit limits use.

Electroless nickel baths have also been employed to plate such fibers but again there is the same problem, the initial nickel or other electroless metal seeds only small spots through holes in the boundary layer, then new metal grows up like a mushroom and joins into what looks like a continuous coating, but it too will fall off when the fiber is twisted. The intermetallic compound is very locally nucleated and this, too, limits use. In the case of both vacuum deposition and electroless deposition, the strength of the metal-to-core bond is always substantially less than one-tenth that of the tensile strength of the metal deposit itself.

Finally, electroplating with nickel and other metals is also featured in reported attempts to provide carbon finers with a metal layer to make compatible with metals and plastics, e.g., R. V. Sara, U.S. Pat. No. 3,622,283. Short lengths of carbon fibers were clamped in a battery clip, immersed in an electrolyte, and electroplated with nickel. When the plated fibers were put into a tin metal matrix, the fibers did not translate their strength to the matrix to the extent expected from the rule of mixtures. When fibers produced by such a process are sharply bent, on the compression side of the bend there appear a number of transverse cracks and on the tension side of the bend the metal breaks and flakes off. If the metal coating is mechanically stripped, and the reverse side is examined under a high-power microscope, there is either no replica or at best only an incomplete replica of the fibril, the replica defined to the 40 angstrom resolution of the scanning electron microscope. The latter two observations are strongly suggestive the failure to reinforce the tin matrix was due to poor bonding between the carbon and the nickel plating. In these cases, the metal to core bond strength is no greater than one-half of the tensile strength on at most 10% of the fibers, and substantially less than one-tenth on the remaining 90%.

It has now been discovered that if electroplating is selected, and if a very high order of external voltage is applied, much higher than was thought to be achievable in the prior art, uniform, continuous adherent, thin metal coatings can be provided to reinforcing fibrils, especially carbon fibrils. The voltage must be high enough to provide energy sufficient to push the metal ions through the boundary layer to provide uniform nucleation with the fibrils directly. Composites of yarns or tows comprising the thin metal coating on fibers, woven cloth, yarns, and the like, according to this invention can be knotted and folded without the metal flaking off. The composites are distinguishable from any of the prior art because they can be sharply bent without the fibrils slipping through a tube of the metal, as observed with electroless metal or vacuum deposited composites and sharply bending them, especially with nickel, produces neither transverse cracking ("alligatoring") on the compression side of the bend nor breaking and flaking when the elastic limitn of the metal is exceeded on the tension side of the bend. In other words, the composites of the present invention are distinguishable from those of the prior art because (i) they are continuous, (ii) the majority of the composite fibers are uniformly metal coated; and (iii) the bond strength (metal-to-core) on the majority of fibers is at least about 10 percent of the tensile strength of the metal deposit, preferably not substantially less than about 25 percent, especially preferably not substantially less than about 50 percent. In the most preferred embodiments, the metal-to-core bond strength will be not substantially less than about 90 percent of the tensile strength of the metal deposit. Highest properties will be achieved with yarns or tows of composite fibers in which the metal-to-core bond strength approaches about 99 percent of the tensile strength of the metal, and special mention is made of these.

Articles made by adding the yarns or tows of the present invention to a matrix forming material also distinguish from the prior art because they are strongly reinforced. In addition, the articles possess other advantages, for example, they dissipate electrical charges and if certain innocuous metals are used in the coatings, e.g., gold and platinum, they will not be rejected when implanted into the body.

BRIEF DESCRIPTION OF THE DRAWINGS

The invention may be more readily understood by reference to the accompanying drawings in which.

Figure 1:
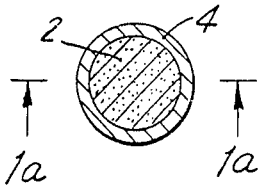
FIG. 1 is a transverse cross sectional view of a metal coated fiber of this invention.

All the drawings represent models of the articles described.

SUMMARY OF THE INVENTION

According to the present invention, continuous tows or yarns of high strength composite fibers are provided, the majority of which fibers comprise a core and at least one thin, uniform, firmly adherent, electrically conductive layer of at least one electrodepositable metal, the bond strength of said layer to said core being not substantially less than about 10 percent of the tensile strength of the metal. The bond strength in each fiber is at least sufficient to provide that when the fiber is bent sharply enough to break the coating on the tension side of the bend because its elastic limit is exceeded, the coating on the compression side of the bend will remain bonded to the core and will not crack circumferentially.

In preferred features the core comprises carbon, boron or silicon carbide, especially carbon fibrils.

The most preferred yarns of composite fibers will be those in which, when the coating is removed by mechanical means and examined, there will be a replica of the fiber or fibril surface on the innermost surface of the removed coating, as examined under a scanning electron microscope of a definition of 40 angstroms or better.

Among the features of the invention are knottable tows or yarns of the new composite fibers, fabrics woven from such yarns, non-woven sheets, mats and papers laid up from such fibers, chopped strands of such fibers and articles comprising such fibers uniformly dispersed in a matrix comprising a metal or an organic polymeric material. In preferred embodiments, coating metals will be nickel, silver, zinc, copper, lead, arsenic, cadmium, tin, cobalt, gold, indium, iridium, iron, palladium, platinum, tellurium, tungsten or a mixture of any of the foregoing, without limitation, preferably in crystalline form.

In another principal aspect the present invention contemplates a process for the production of continuous tows or yarns of high strength composite fibers, said process comprising:

(a) providing a continuous length of a plurality of electrically conductive semi-metallic core fibers,
(b) immersing at least a portion of the length of said fibers in a bath capable of electrolytically depositing at least one metal,
(c) applying an external voltage between the fibers and the bath in excess of that which is sufficient to (i) dissociate the particular metal and (ii) to uniformly nucleate the dissociated metal through any barrier layer onto the surface of said fibers; and
(d) maintaining said voltage for a time sufficient to produce a thin, uniform, firmly adherent, electrically conductive layer of electrolytically deposited metal on said core, the bond strength of said layer to said core being not substantially less than about 10 percent of the tensile strength of the metal.

In preferred features, the process will use core fibers of carbon, boron or silicon carbide, especially preferably carbon fibrils.

In one preferred embodiment the plurality of core fibers comprise a tow of carbon fibers and the product of the process is a tow of composite fibers which can be knotted without separation of the layer of metal or portions thereof from the core fibers.

Other preferred features comprise the steps of weaving or knitting yarns produced by the process into a fabric, laying them up into a non-woven sheet, or chopping them into shortened lengths.

Other preferred features include carrying out the process in an electrolytic bath which is recycled into contact with the fibers immediately prior to immersion in the bath so as to provide increased current carrying capacity to the fibers and replenishment of the electrolyte on the surface of the fibers.

DETAILED DESCRIPTION OF THE INVENTION

Figure 1A:
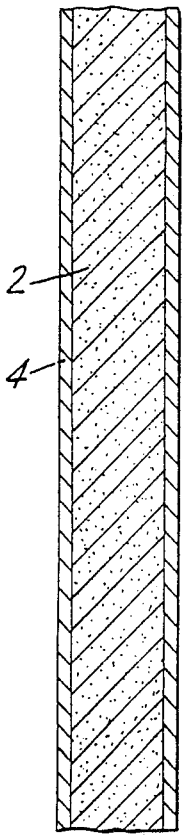
FIG. 1*a* is a longitudinal cross sectional view of a metal fiber according to this invention.

Referring to FIGS. 1 and 1*a* continuous yarns and tows for use in the core 2 according to the present invention are available from a number of sources commercially. For example, suitable carbon fiber yarns are available from Hercules Company, Hitco, Great Lakes Carbon Company, AVCO Company and similar sources in the United States, and overseas. All are made, in general, by procedures described in U.S. Pat. No. 3,677,705. The fibers can be long and continuous or they can be short, e.g., 1 to 15 cm. in length. As mentioned above, all such carbon fibers will contain a thin, imperfect boundary layer (not shown) of chemically bonded oxygen and chemically or mechanically bonded other materials, such as organics.

Figure 3:
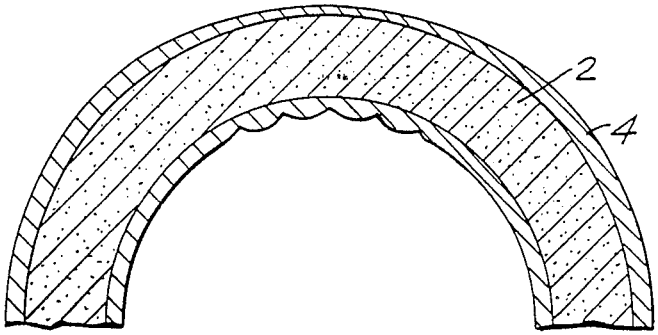
FIG. 3 shows a longitudinal cross section of sharply bent metal coated fiber according to this invention.
Figure 3A:
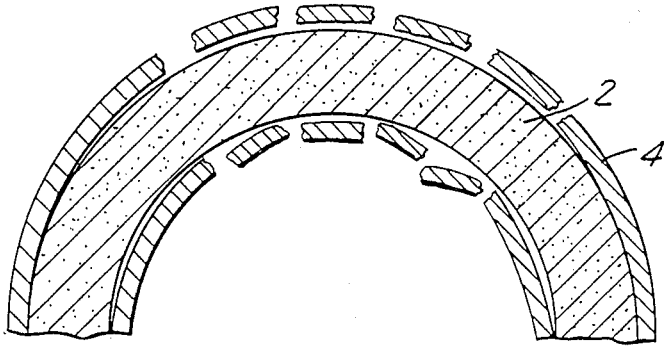
(PRIOR ART) FIG. 3a
FIG. 3*a* shows a longitudinal cross section of a sharply bent metal coated composite prepared according to the prior art.
Figure 2:
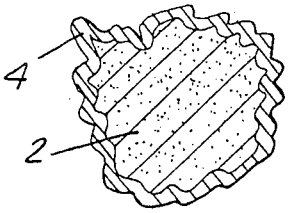
FIGS. 2 and 2*a* are transverse cross sectional views of, respectively, a multinodal core and a "cracked" core fiber coated with metal according to this invention.
Figure 2A:
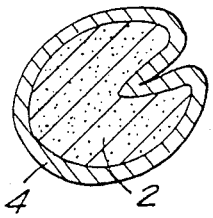
Figure 4:
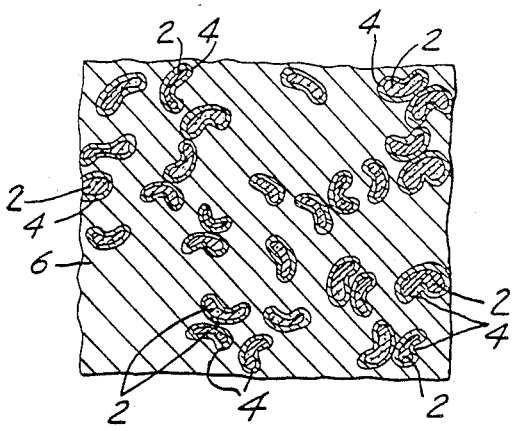
FIG. 4 is a partial sectional view of a metal coated composite fiber-reinforced polymer obtained by using this invention.

Metal layer 4 will be of any electrodepositable metal, and it will be electrically continuous. Two layers, or even more, of metal can be applied and metal can be the same or different, as will be shown in the working examples. In any case, the innermost layer will be so firmly bonded to core 2 that sharp bending will neck the metal down as shown in FIG. 3, snapping the fiber core and breaking the metal on the tension side of the bend when its elastic limit is exceeded. This is accomplished without causing the metal to flake off when broken (FIG. 3*a*), which is a problem in fibers metal coated according to the prior art. As a further distinction from the prior art, the metal layer of the present invention fills interstices and "cracks" in fibers, uniformly and completely, as illustrated in FIGS. 2 and 2*a*.

Figure 5:
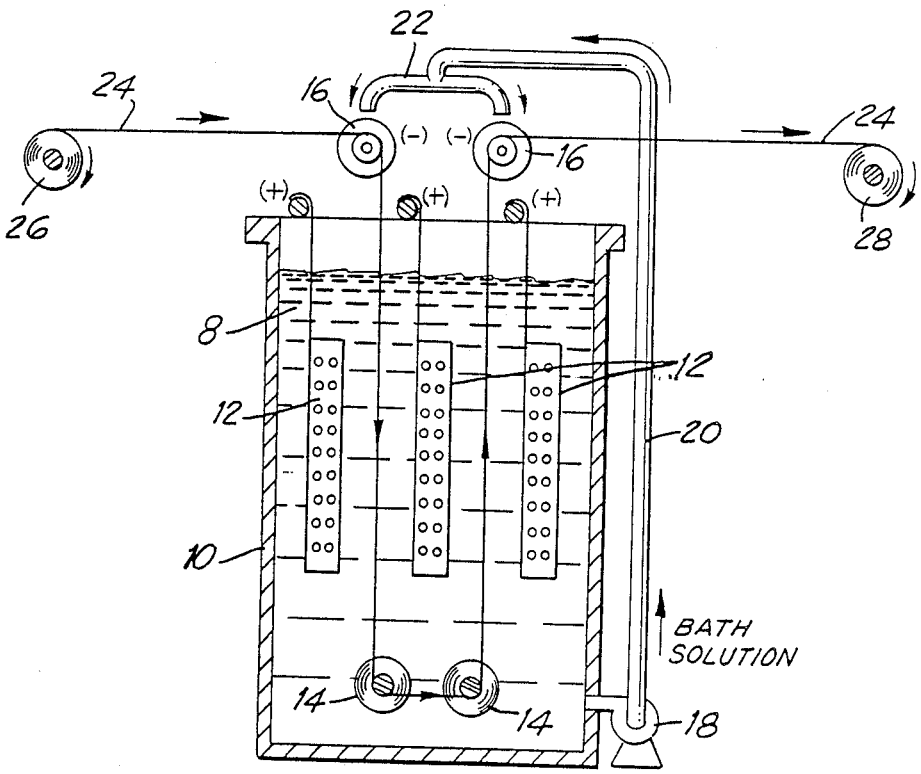
FIG. 5 is a view showing an apparatus for carrying out the process of the present invention.

The high strength metal coated fibers of this invention can be assembled by conventional means into composites represented in FIG. 5 in which matrix 6 is a plastic, e.g., epoxy resin, or a metal, e.g., lead, the matrix being reinforced by virtue of the presence of high strength fibrous cores 2.

Formation of the metal coating layer by the electrodeposition process of this invention can be carried out in a number of ways. For example, a plurality of core fibers can be immersed in an electrolytic bath and through suitable electrical connections the required high external voltage can be applied. In one manner of proceeding, a high order of voltage is applied for a short period of time. A pulse generator, for example, will send a surge of voltage through the electrolyte, sufficient to push or force the metal ion through the boundary layer into contact with the carbon or other fiber comprising the cathode. The short time elapsing in the pulse will prevent heat from building up in the fiber and burning it up or out. Because the fibers are so small, e.g., 5 to 10 microns in diameter, and because the innermost fibers are usually surrounded by hundreds or even thousands of others, even though only 0.5 to 2.6 volts are needed to dissociate the electrolytic metal ion, e.g., nickel, gold, silver, copper, depending on the salt used, massive amounts of external voltage are needed, of the order of 5 times the dissociation values, to uniformly nucleate the ions through the bundle of fibers into the innermost fibril and then through the boundary layer. Minimum external voltages of e.g., 10 to 50, or even more, volts are necessary.

Although pulsing as described above is suitable for small scale operations, for example, to metallize pieces of woven fabrics, and small lengths of carbon fiber yarns or tows, it is preferred to carry out the procedure in a continuous fashion on a moving tow of fibers. To overcome the problem of fiber burnout because of the high voltages to keep them cool enough outside the bath, one can separate the fibers and pour water on them, for example, but it is preferred to operate in an apparatus shown schematically in FIG. 5. Electrolytic bath solution 8 is maintained in tank 10. Also included are anode baskets 12 and idler rolls 14 near the bottom of tank 10. Two electrical contact rollers 16 are located above the tank. Tow 24 is pulled by means not shown off feed roll 26, over first contact roller 16 down into the bath under idler rolls 14, up through the bath, over second contact roller 16 and into take up roller 28. By way of illustration, the immersed tow length is about 6 feet. Optional, but very much preferred, is a simple loop comprising pump 18, conduit 20, and feed head 22. This permits recirculating the plating solution at a large flow rate, e.g., 2–3 gallons/min. and pumping it onto contact rolls 16. Discharged just above the rolls, the sections of tow 24 and leaving the solution are totally bathed, thus cooling them. At the high current carried by the tow, the $I^2R$ heat generated in some cases might destroy them before they reach or after they leave the bath surface without such cooling. The flow of the electrolyte overcomes anisotropy. Of course, more than one plating bath can be used in series, and the fibers can be rinsed free of electrolyte solution, treated with other conventional materials and dried, chopped, woven into fabric, all in accordance with conventional procedures.

DESCRIPTION OF THE PREFERRED EMBODIMENTS

The following Examples illustrates the present invention, but are not intended to limit it.

EXAMPLE 1

In a continuous electroplating system, a bath is provided having the following composition:

| Ingredient | Amount |
|---|---|
| nickel sulfate ($NiSO_4.6H_2O$) | 40 ounces/gallon |
| nickel chloride ($NiCl_2.6H_2O$) | 12–20 ounces/gallon |
| boric acid ($H_3BO_3$) | 5–8 ounces/gallon |
| wetting agent (WA-129, State Chemical) | 2% by volume |
| brightener (Starlite 915, State Chemical) | 2% by volume |

The bath is heated to 140°–160° F. and has a pH of 3.8–4.2.

The anode baskets are kept filled with electrolytic nickel pellets and 4 tows (fiber bundles) of 12,000 strands each of 7 micron carbon fibers are continuously drawn through the bath while an external voltage of 30 volts is applied at a current adjusted to give 10 ampere-minutes per 1000 strands total. At the same time, electrolytic solution is recycled through a loop into contact with the entering and leaving parts of the tow. The tow is next passed continuously through an identical bath, at a tow speed of 5.0 ft./min. with 180 amps. current in each bath. The final product is a tow of high strength composite fibers according to this invention comprising a 7 micron fiber core and about 50% by weight of the composite of crystalline electrodeposited nickel adhered firmly to the core.

If a length of the fiber is sharply bent, then examined, there is no circumferential cracking on the metal coating in the tension side of the bend. The tow can be twisted and knotted without causing the coating to flake or come off as a powder. If a section of the coating is mechanically stripped from the fibrils, there will be a perfect reverse image (replica) on the reverse side.

EXAMPLE 2

If the procedure of Example 1 is repeated, substituting two baths of the following compositions, in series, and using silver in the anode baskets, silver coated graphite fibers according to this invention will be obtained.

| Ingredient | First Bath | Second Bath |
|---|---|---|
| Silver Cyanide | 0.1–0.3 oz./gal. | 7–11 oz./gal. |
| Potassium Cyanide | 12–20 oz./gal. | 12 oz./gal. |
| Potassium Hydroxide | — | 1–2 oz./gal. |

The first bath is to be operated at room temperature and 12–36 volts; the second at room temperature and 6–18 volts.

EXAMPLE 3

The procedure of Example 2 can be modified, by substituting nickel plated graphite fibers as prepared in Example 1 for the feed, and the voltage in the first bath is reduced to about 18 volts. There are obtained high strength composite fibers according to this invention in which a silver coating surrounds a nickel coating on a graphite fiber core.

EXAMPLE 4

The procedure of Example 1 can be modified by substituting for the nickel bath a bath of the following composition, using zinc in the anode baskets, and zinc coated graphite fibers according to this invention will be obtained:

| Ingredient | Amount |
|---|---|
| Zinc sulfate | 8 oz./gal. |
| Ammonium alum | 3–4 oz./gal. |
| Potassium hydroxide | 16 oz./gal. |
| Potassium cyanide | 3 oz./gal. |

The bath is run at 100° F. and 18 volts are externally applied.

EXAMPLE 5

The procedure of Example 1 can be modified by substituting for the nickel bath a bath of the following composition, using copper in the anode baskets, and copper coated graphite fibers according to this invention will be obtained:

| Ingredient | Amount |
|---|---|
| Copper cyanide | 3.5 oz./gal. |
| Sodium cyanide | 4.6 oz./gal. |
| Sodium carbonate | 4 oz./gal. |
| Sodium hydroxide | 0.5 oz./gal. |
| Rochelle salt | 6 oz./gal. |

The bath is run at 140° F. and 18 volts are externally applied. The copper plated fibers should be washed with sodium dichromate solution immediately after plating to prevent tarnishing. If the procedure of Example 3 is repeated, substituting the copper bath of this example for the silver bath, there will be obtained high strength composite fibers according to this invention in which a copper coating surrounds a nickel coating on a graphite fiber core.

EXAMPLE 6

The procedure of Example 1 can be modified by substituting for the nickel bath two baths of the following composition, using standard 80% cu/20% zinc anodes, and brass coated graphite fibers according to this invention will be obtained:

| Ingredient | Amount |
|---|---|
| Copper cyanide | 4 oz./gal. |
| Zinc cyanide | 1.25 oz./gal. |
| Sodium cyanide | 7.5 oz./gal. |
| Sodium carbonate | 4 oz./gal. |

Both baths are run at 110°–120° F. Since one-third of the brass is plated in the first bath, at 24 volts, and two-thirds in the second at 15 volts, the current is proportioned accordingly. Following two water rinses, the brass plated fibers are washed with a solution of sodium dichromate, to prevent tarnishing, and then rinsed twice again with water.

EXAMPLE 7

The procedure of Example 1 can be modified by substituting for the nickel bath a bath of the following composition, using solid lead bars in the anode baskets, and lead coated graphite fibers according to this invention will be obtained:

| Ingredient | Amount |
|---|---|
| Lead fluoborate, $Pb(BF_4)_2$ | 14 oz. Pb/gal. |
| Fluoboric acid, $HBF_4$ | 13 oz./gal. |

Optionally, about 2 g./l. of $\beta$-naphthol and of gelatine are added. The pH is less than 1, the bath is operated at 80° F. and an external voltage of 12 volts is applied. If the coating thickness exceeds 0.5 microns, there is a tendency for the lead to bridge between individual filaments.

EXAMPLE 8

By the general procedure of Example 1, and substituting a conventional gold bath for the nickel electroplating bath and applying sufficient external voltage, composite high strength fibers comprising gold on graphite fibers are obtained.

EXAMPLE 9

Silicon carbide filaments and boron fibers are coated with nickel by placing them in cathodic contact with a nickel plating bath of Example 1 and applying an external voltage of about 30 volts.

EXAMPLE 10

A composition is prepared by chopping the composite fibers of Example 1 into short lengths, $\frac{1}{8}''$ to 1" long, then thoroughly mixing with thermoplastic nylon polyamide in an extruder, and chopping the extrudate into molding pellets in accordance with conventional procedures. The pellets are injection molded into plaques $4'' \times 8'' \times \frac{1}{8}''$ in size. The plaque is reinforced by the composite fibers. By virute of the metal content, it also does not build up static charge, and it can act as an electrical shield in electronic assemblies.

EXAMPLE 11

Bundles of nickel plated graphite fibers of about one inch in length prepared according to the procedure of Example 1 are mixed 1:9 with uncoated graphite fibers and laid up into a non woven mat, at 1 oz./1 sq. yard. The mat has a metal content of about 5% by weight of nickel and ca be impregnated with thermosetting resin varnishes and consolided under heat and pressure into reinforced laminates having high strength and excellent electrical dissipation properties.

EXAMPLE 12

Long, nickel coated graphite yarns prepared by the general procedure of Example 1 are pultruded at a high rate with molten lead in an apparatus from which a $\frac{1}{8}''$ diameter rod issues in solidified form, down through the center of which runs the nickel coated graphite fibers. The lead is alloyed to the nickel without complete solvency of the nickel and the nickel is well bonded to the graphite fibrils. This results in a translation of the physical strength of the graphite fibers through the nickel plating, nickel/lead interpose to the lead matrix. A section of the rod is pulled in an apparatus to measure breaking strength. In comparison with a lead rod of the same diameter, the breaking strength nickel coated graphite fibers of this invention is very much higher.

The foregoing patents and publications are incorporated herein by reference. Many variations of the present invention will suggest themselves to those skilled in this art in light of the above, detailed description. For example, aluminum can be deposited from ethereal solutions. Metals, e.g., tungsten, can be deposited from molten salt solutions, e.g., sodium tungstenate. The tow ca be treated to remove metal from sections thereof, and thereby segmented structures are provided which have utility, for example, as electrical resistors. All such variations are within the full intended scope of the invention as defined in the appended claims.

What is claimed is:

1. A process for the production of continuous yarns or tows of high strength composite fibers, said process comprising:

(a) providing a continuous length of a plurality of electrically conductive graphite core fibers, (b) continuously immersing at least a portion of the length of said fibers in a bath capable of electrolytically depositing at least one metal, (c) applying an external voltage of at least 10 volts to the fiber immediately prior to immersion in the bath;

(d) maintaining said voltage and resulting current for a time sufficient to produce a thin, uniform, firmly adherent, electrically conductive layer of electrolytically deposited metal on said core; and (e) maintaining the yarns or tows cool enough outside the bath to prevent degradation of the said fibers by recycling the bath to bathe the yarns or tows from the point of application of the external voltage to the point of immersion in the bath.

2. A process as defined in claim 1 wherein the applied external voltage is between 10 and 50 volts.

3. A process as defined in claim 2 wherein the applied external voltage is between 12 and 36 volts.

4. A process as defined in claim 3 wherein the applied external voltage is in excess of 13.0 volts.

5. A process as defined in claim 1 wherein the bond strength of said layer to said core in the majority of said fibers is at least sufficient to provide that when the composite fiber is bent sharply enough to break the coating on the tension side of the bend because its elastic limit is exceeded, the coating on the compression side of the bend will remain bonded to the core and will not crack circumferentially.

6. A process as defined in claim 1 wherein said electrolytically deposited metal is crystalline.

7. A process as defined in claim 1 wherein the product of the process is a tow or yarn of composite fibers which can be knotted without separation of the layer of metal or portions thereof from the core fibers.

8. A process as defined in claim 1 including the step of weaving or knitting yarns produced by the process alone, or in combination with yarns of a different material in to a fabric.

9. A process as defined in claim 1 including the step of laying up the yarns produced by the process alone, or in combination with yarns or a different material into a non-woven sheet.

10. A process as defined in either of claims 8 or 9 including weaving, knitting or laying up the material into a three-dimensional article of manufacture.

11. A process as defined in claim 1 including the step of chopping the yarns produced by the process into shortened lengths.

12. A process as defined in any of claims 8, 9 or 11 including the step of forming a reinforced composite by intimately contacting a metal or an organic polymer material with at least a reinforcing amount of said yarn, sheet or chopped fibers.

13. A reinforced composite prepared by the process of claim 12.

14. A reinforced composite prepared by the process of claim 12 wherein the amount of yarn, sheet or chopped fibers is at least sufficient to provide an electrostatically shielded reinforced composite.

15. A single fiber recovered from a continuous yarn or tow produced by the process of claim 1.

* * * * *